US006361045B1

(12) United States Patent
Bernstein

(10) Patent No.: US 6,361,045 B1
(45) Date of Patent: Mar. 26, 2002

(54) PUZZLES WITH PRESSURE-SENSITIVE STICK-ON PIECES

(75) Inventor: Robert Bernstein, Chappaqua, NY (US)

(73) Assignee: Peel Off Promotion, Inc., New York, NY (US)

( * ) Notice: Subject to any disclaimer, the term of this patent is extended or adjusted under 35 U.S.C. 154(b) by 0 days.

(21) Appl. No.: 09/501,255

(22) Filed: Feb. 9, 2000

(51) Int. Cl.[7] ..... A63F 9/10
(52) U.S. Cl. ..... 273/157 R; 273/157 A
(58) Field of Search ..... 473/157 R, 157 A, 473/153 R, 156

(56) References Cited

U.S. PATENT DOCUMENTS 3,707,287 A * 12/1972 Spector ..... 273/157 R
4,336,664 A * 6/1982 Penick et al. ..... 273/157 R
4,586,714 A * 5/1986 Lenkoff et al. ..... 273/157 R
5,232,088 A * 8/1993 Leondidis ..... 273/157 R
5,439,220 A * 8/1995 Hendricks ..... 273/157 R
5,472,199 A * 12/1995 Rainey ..... 273/157 R
5,829,744 A * 11/1998 Nelson ..... 273/157 R

* cited by examiner

*Primary Examiner*—Steven Wong
(74) *Attorney, Agent, or Firm*—Levine & Mandelbaum

(57) ABSTRACT

A puzzle game wherein scrambled puzzle pieces are printed on a top layer of pressure-sensitive material which is die cut to create the shapes of the pieces. In a two-layer version of the puzzle, the pressure-sensitive material is laminated to a bottom layer formed from a silicone-coated liner. The bottom surface of the bottom layer is printed with instructions, e.g., a grid having rectangles with numbers which tell where to place the correspondingly numbered scrambled pressure-sensitive puzzle pieces. When the pressure-sensitive pieces are applied to the liner, rearranged as per the grid or other instructions, a picture and/or message is revealed. An intermediate layer may be hidden between the top and bottom layers for serving as a coupon, ticket or other device which be relinquished without parting with the completed puzzle.

10 Claims, 10 Drawing Sheets

PUZZLES WITH PRESSURE-SENSITIVE STICK-ON PIECES

BACKGROUND OF THE INVENTION

This invention relates to novelty puzzles of the type where pieces representing portions of an image are to be unscrambled to form the image. More specifically, the invention is directed to a self-contained puzzle kit wherein the puzzle pieces can be mounted on a substrate by means of a pressure-sensitive adhesive.

It is known in the art to employ pressure-sensitive adhesives for fastening puzzle pieces to a support or to otherwise hold them in place, once assembled. However, such puzzles generally require adult supervision or assistance when given to young children to assemble. Some of the many pieces of a puzzle can be lost. Adhesive coated puzzle pieces can be difficult to handle and can stick to surfaces for which they are not intended, or even to one another if not carefully handled. Moreover, very young children often do not have the cognitive ability to transform a scrambled image on the pieces of a puzzle into an unscrambled one.

Prior art puzzles which use adhesives do not lend themselves to holding a child's interest or rewarding a child upon completion of a puzzle, e.g., by providing the child with a prize, separate and apart from the completed puzzle.

SUMMARY OF THE INVENTION

The aforementioned shortcomings of the prior art are overcome by the instant invention which provides for a puzzle game having a top layer with a plurality of disorderly arranged sections each of which has a top surface that bears a portion of a scrambled image, and a bottom surface with a pressure-sensitive adhesive, and a bottom layer having a top surface with an affinity for pressure-sensitive adhesive less than that of the bottom surfaces of the top layer sections, and a bottom surface on which there is imprinted information for orderly arranging the top layer sections in a configuration in which the first image is unscrambled. The pressure-sensitive adhesive on the bottom surfaces of the top layer sections, when subjected to pressure, affixes the bottom surfaces of the top layer sections to the bottom surface of the bottom layer thereby producing an assemblage bearing the unscrambled image.

An intermediate layer may be sandwiched in between the top and bottom layers for being hidden when the puzzle is in its original scrambled state and for being exposed and separable from the top and bottom layers for use, e.g., as a prize coupon, while permitting the completed puzzle with the unscrambled image to be separately retained.

The bottom layer upper surface may have a release coating for use with an intermediate layer that has a pressure-sensitive adhesive on its underside. Alternatively, the bottom layer upper surface may be coated with a pressure-sensitive adhesive, a fugitive adhesive, or a repositionable adhesive for use where the intermediate layer has a bottom surface with a release coating.

It is therefore an object of the invention to provide a self-contained puzzle which can be readily assembled by young children with little or no supervision.

Another object of the invention is to provide a puzzle wherein directions for assembly of the puzzle are integral with a backer to which the unscrambled puzzle pieces are to be adhered.

Still another object of the invention is to provide a puzzle wherein each piece can be removed from its position in a scrambled image and repositioned to its position in an unscrambled image without need to remove any other piece of the puzzle.

A further object of the invention is to provide a puzzle wherein a concealed coupon, picture, certificate or the like can be exposed for separation from the puzzle when the puzzle is completed.

Other and further objects of the invention will be apparent from the following drawings and description of a preferred embodiment of the invention in which like reference numerals are used to indicate like parts in the various views.

DESCRIPTION OF THE PREFERRED EMBODIMENT

Figure 1:
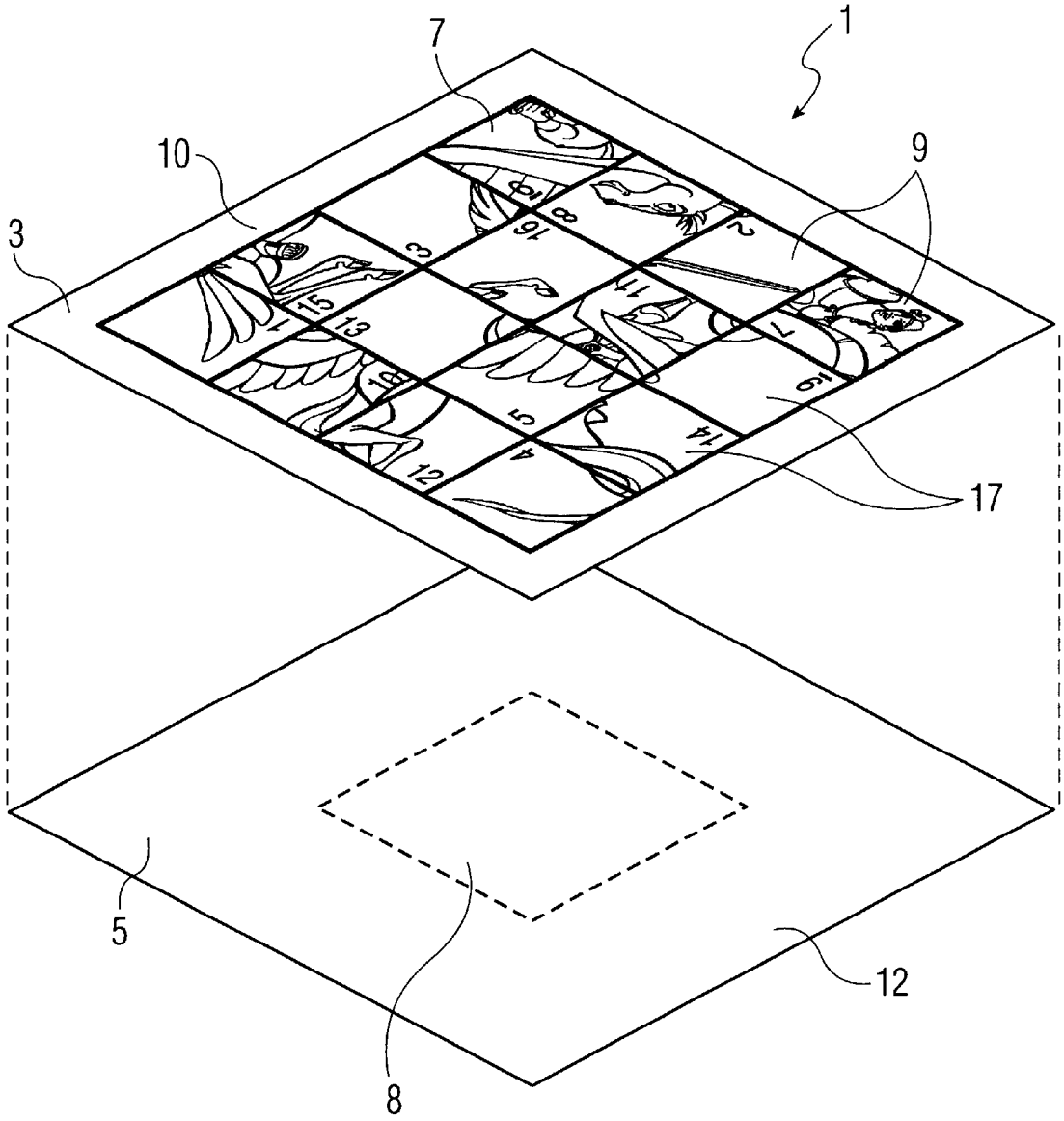
FIG. 1 is an exploded perspective view of a puzzle in accordance with a preferred embodiment of the invention in an original state.
Figure 2:
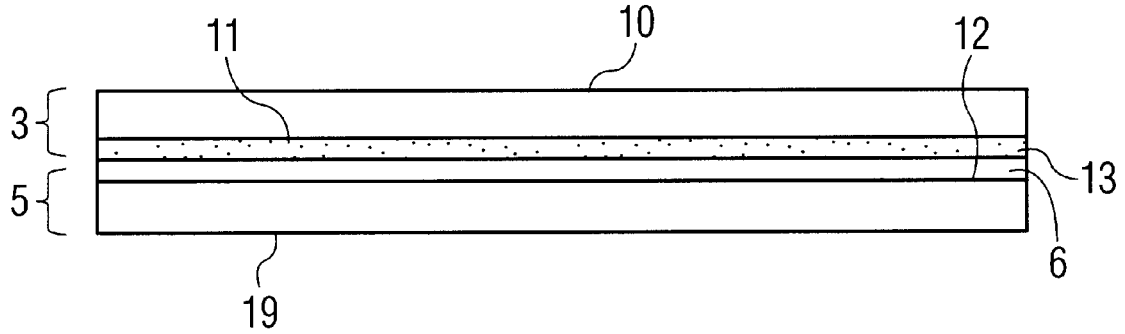
FIG. 2 is a side elevation view of the puzzle of FIG. 1.
Figure 3:
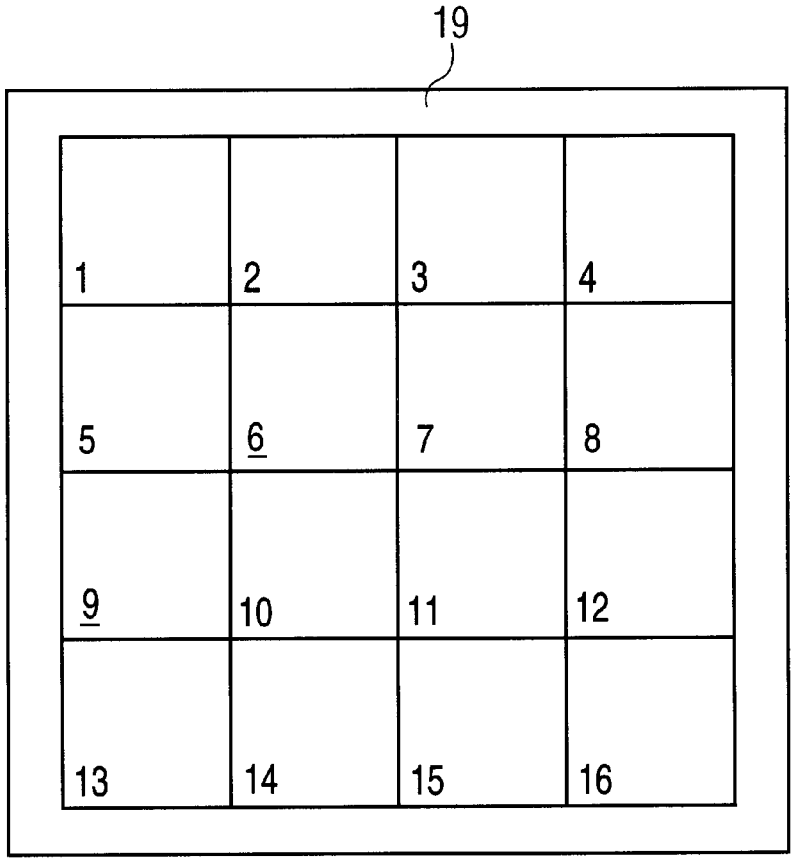
FIG. 3 is a bottom plan view of the puzzle of FIG. 1.
Figure 4:
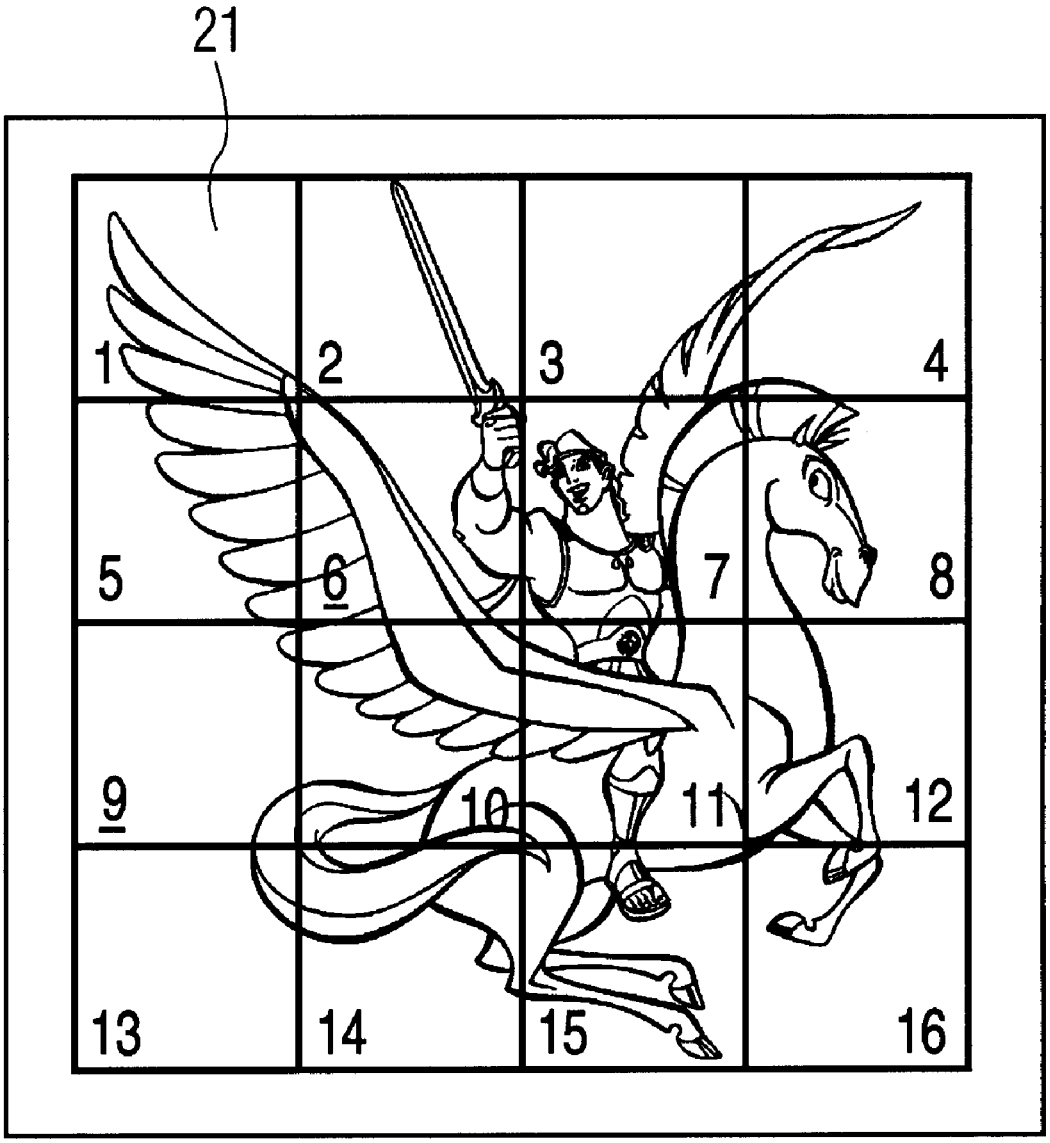
FIG. 4 is a bottom plan view of the puzzle of FIG. 1 in a completed state.

Referring now to FIGS. 1–4 of the drawings, there is shown a puzzle 1 having a square top layer 3 and a square bottom layer 5 which is congruent to the top layer 3. The top layer 3 is preferably formed from a sheet of vinyl, although it can be made of paper or other sheet material.

Printed on the top surface 10 of the top layer 3 is a scrambled image 7 having numbered regions 9. The top surface 12 of the bottom layer 5 has a silicone coating 6. In its original state, the bottom surface 11 of the top layer 3 is coated with a pressure-sensitive adhesive 13 and applied to the silicone coated top surface 12 of the bottom layer 5. Because the pressure-sensitive adhesive 13 has a greater affinity for the vinyl or paper on the bottom surface 11 of the top layer 3 than it does for the silicone coated top surface 12 of the bottom layer 5, the adhesion between the top layer 3 and bottom layer 5 is impermanent.

The top layer 3 is die cut so that the numbered regions 9 are on separate congruent square pieces 17 forming a four by four matrix. Each square 17 has a number indicative of its position relative to the other pieces 17 when the image is unscrambled. Also, the orientation of each number indicates the proper orientation of each piece 17 in the finished puzzle 1. That is, when the pieces 17 are rotated so that the numbers are upright, the pieces 17 are also in the upright positions required to form the unscrambled image 21.

The die cut is deep enough to penetrate the thickness of the top layer 3 but not deep enough to cut the bottom layer 5. The pressure-sensitive adhesive 13 holds the pieces 17 of the puzzle 1 in place until they are peeled away from the silicone-coated top surface 12 of the bottom layer 5.

Printed on the bottom surface 19 or underside of the bottom layer 5 is information on how to arrange the puzzle pieces 17 to form the unscrambled image 21, in the form of a grid made up of squares each of which is congruent to the die cut puzzle pieces 17. Each square of the grid has a unique number corresponding to a number on one of the puzzle pieces 17 and an orientation corresponding to the proper orientation of the numbers on the puzzle pieces 17 in the unscrambled image 21. The correspondences of the numbers on the puzzle pieces 17 and grid, and their orientations, enables young children to easily arrange the puzzle pieces 17 to form the unscrambled image 21.

In order to assemble the unscrambled image 21, each die cut square of the upper layer is peeled away from the top silicone-coated surface 10 of the bottom layer 5 and placed on its correspondingly numbered square on the grid printed on the bottom surface 19 of the bottom layer 5. Pressure is then applied against the die cut square thereby causing the pressure-sensitive adhesive 13 to bond the die cut square to the bottom layer 5. Bonding all of the die cut squares to the bottom layer 5 in the aforesaid manner forms a complete unscrambled image 21 on the bottom surface 19 of the bottom layer 5.

The silicone-coated top surface 12 of the bottom layer can optionally have a picture, message, and/or other textual or graphical representation to form another image 8 which is hidden by the top layer 3 until the die cut puzzle pieces 17 are peeled away from the top layer 3. As the puzzle pieces 17 are peeled away, the text and or graphics on the top surface 12 of the bottom layer 5 is gradually exposed. Children may guess at the full content of the hidden image before it is fully exposed. When all of the puzzle pieces 17 have been removed from the top surface 12 of the bottom layer 5 and affixed to the bottom surface 19 of the bottom layer 5, the puzzle 1 consists of a single two-sided assembly having the unscrambled image 21 formed by the assembled pieces 17 on one side and the previously hidden image on the other side.

Figure 5:
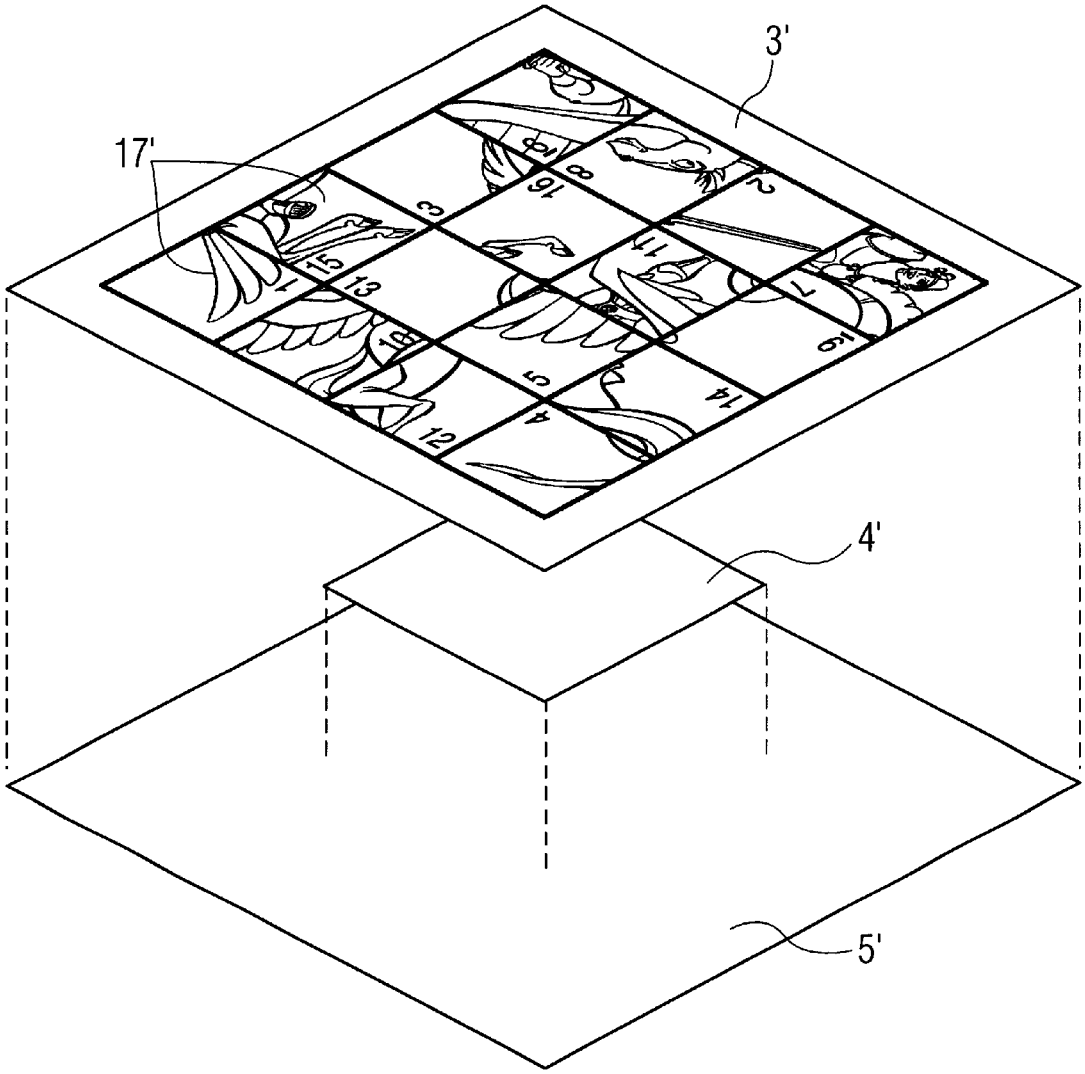
FIG. 5 is an exploded perspective view of a puzzle in accordance with a first variant of the preferred embodiment of the invention.
Figure 6:
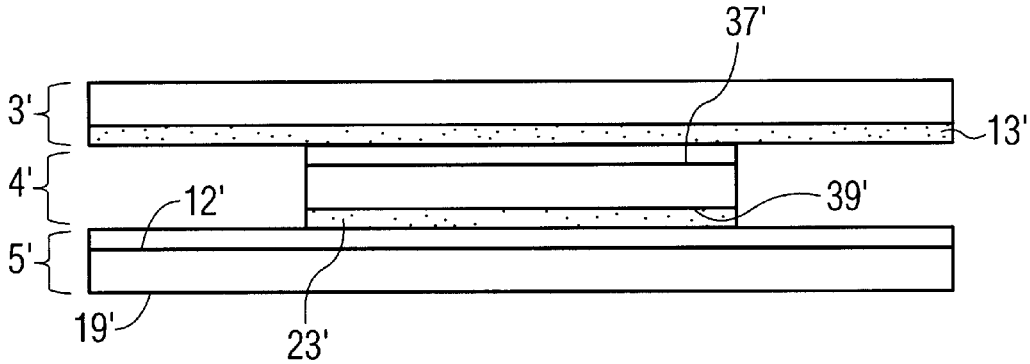
FIG. 6 is a side elevation view of the puzzle of FIG. 5.

Referring now to FIGS. 5 and 6 of the drawings, there is shown a variant of the embodiment of FIGS. 1–4 wherein an intermediate layer 4' is disposed between the top layer 3' and bottom layer 5' of the puzzle 1'. The intermediate layer 4' can serve as a coupon for a prize or purchase, an admission ticket to an event, a telephone calling card, or for other purposes. The intermediate layer 4' can consist of a single sheet; it can be a packet having an envelope in which one or more sheets are contained; or it can be a folded leaflet or a booklet.

The top layer 3' and bottom layer 5' of the puzzle 1' are as described with respect to FIGS. 1–4. The intermediate layer 4' has a top surface 37' which is silicone-coated and a bottom surface 39' that is optionally coated with a pressure-sensitive adhesive 23'. The intermediate layer 4' can be smaller in area than the top layer 3' and bottom layer 5'. The bottom surface 39' of the intermediate layer 4' is removably affixed to the top surface 12' of the bottom layer 5' by means of the pressure-sensitive adhesive 23' on the bottom surface 39' of the intermediate layer 4'. Preferably, but not necessarily, the intermediate layer 4' is centered on the bottom layer 5= before being "pressed" onto it so that the pressure-sensitive adhesive 23' on the bottom surface 39' of the intermediate layer 4' removably adheres the intermediate layer 4' to the bottom layer 5'. Thereafter the top layer 3' is placed over the bottom layer 5' and pressed against the exposed portion of the silicone-coated top surface 12' of the bottom layer 5' and the silicone-coated top surface 37' of the intermediate layer 4' whereby the pressure-sensitive adhesive 13' on the bottom surface 11' of the top layer 3' holds the top layer 3' to the bottom layer 5' with the intermediate layer 4' captured therebetween.

The top layer 3' is then die cut to form puzzle pieces 17' as explained with respect to FIGS. 1–4. When the puzzle pieces 17' are peeled away from the top surface 37' of the intermediate layer 4' the coupon or other device which forms the intermediate layer 4' is exposed and can be peeled from the upper surface 12' of the bottom layer 5'. The puzzle pieces 17' can be affixed to the bottom surface 19' of the bottom layer 5' as explained with respect to FIGS. 1–4 to form the unscrambled image. This arrangement enables the owner of the puzzle 1' to turn in the coupon or ticket formed by the intermediate layer 4' as may be necessary to receive a prize or gain admission to an event, without having to part with the completed puzzle 1'.

Figure 7:
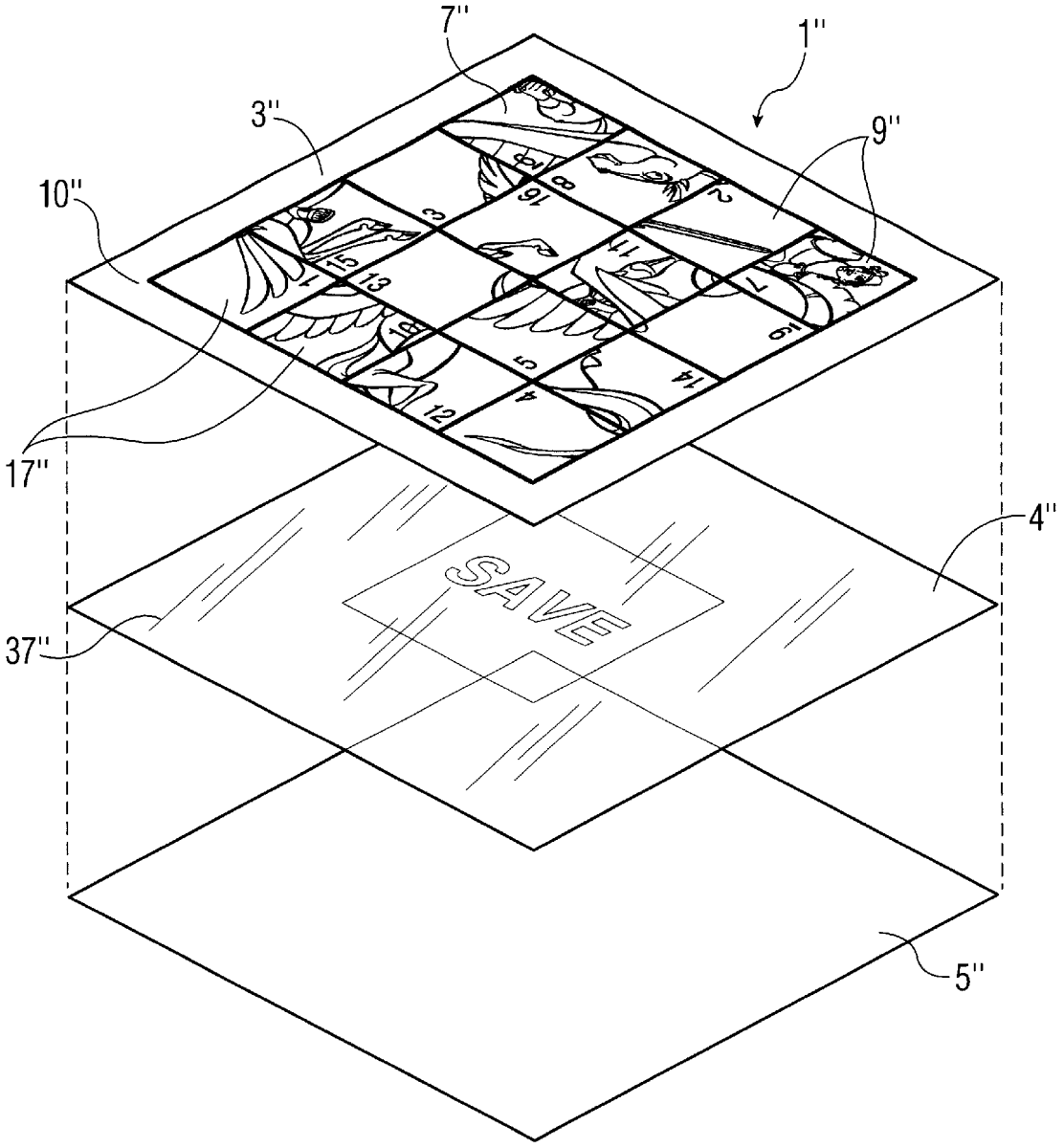
FIG. 7 is an exploded perspective view of a puzzle in accordance with a second variant of the preferred embodiment of the invention.
Figure 8:
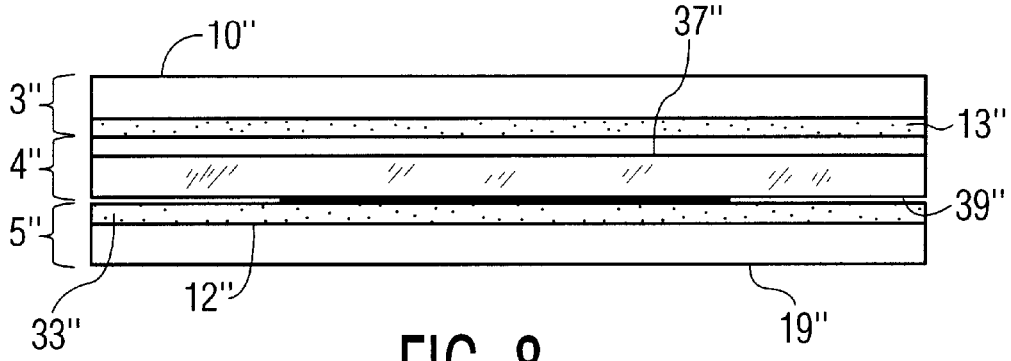
FIG. 8 is a side elevation view of the puzzle of FIG. 7.

Referring now to FIGS. 7 and 8 of the drawings there is shown another variant of the preferred embodiment of the invention. A puzzle 1" has a square top layer 3", a square intermediate layer 4", and a square bottom layer 5", all of the layers 3", 4", and 5" being congruent. As in the previous embodiments, the top layer 3" is preferably formed from a sheet of vinyl, although it, too, can be made of paper or other sheet material.

Printed on the top surface 10" of the top layer 3" is a scrambled image 7" having numbered regions 9". The bottom side of the top layer 3" is coated with a pressure-sensitive adhesive 13". The top layer 3" is die cut into congruent square pieces 17" forming a four by four matrix. Each square has a number indicative of its position and orientation required to form the unscrambled image 21".

The intermediate layer 4" is transparent and can be made of a transparent vinyl, acetate or similar material. The transparent intermediate layer 4" has a top surface 37" with a silicone coating and a bottom surface 39" on which there are printed text and/or graphics in mirror image so that they can be viewed through the top surface 37 of the intermediate layer 4".

The bottom layer or backer 5" has a bottom surface 19" on which a grid, similar to the grids of the puzzles shown in FIGS. 1–6, is printed for receiving the pressure-sensitive adhesive coated puzzle pieces 17". The top surface 12" of the bottom layer 5" is coated with a fugitive adhesive 33" which releasably adheres the bottom surface 39" of the transparent intermediate layer 4" to the top surface of the bottom layer 5" and permits the transparent intermediate layer 4" to be peeled away from the bottom layer 5", leaving no sticky surface on either the bottom surface 39" of the intermediate layer 4" or the top surface 12" of the bottom layer 5". Such fugitive adhesives are known in the art.

The transparent intermediate layer 4" may serve as any of the devices formed by the intermediate layer 4" of the embodiment of FIGS. 5 and 6, including a picture which may be optionally mounted and/or framed, and hung or otherwise displayed.

Figure 9:
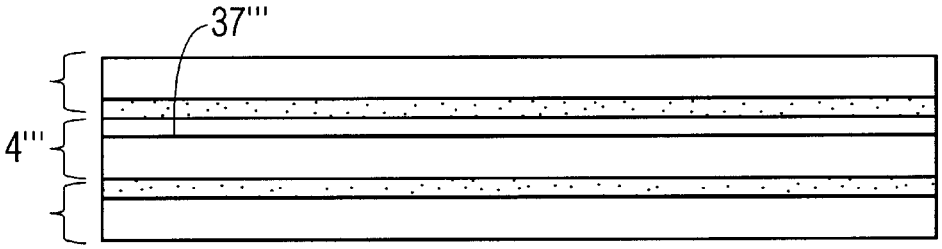
FIG. 9 is a side elevation view of a puzzle in accordance with a third variant of the preferred embodiment of the invention.

In another variant of the invention illustrated in FIG. 9, instead of being transparent, the intermediate layer 4''' is opaque and has text and/or graphics printed on its top surface 37''' before application of the silicone release coating thereto.

Figure 10:
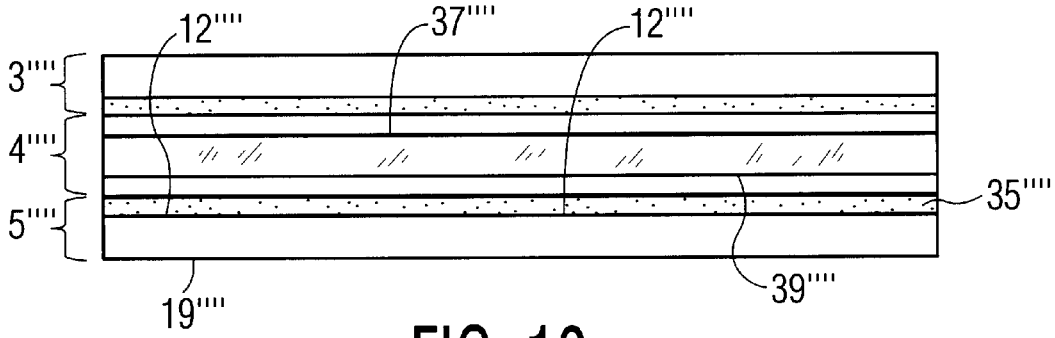
FIG. 10 is a side elevation view of a puzzle in accordance with a fourth variant of the preferred embodiment of the invention.
Figure 11:
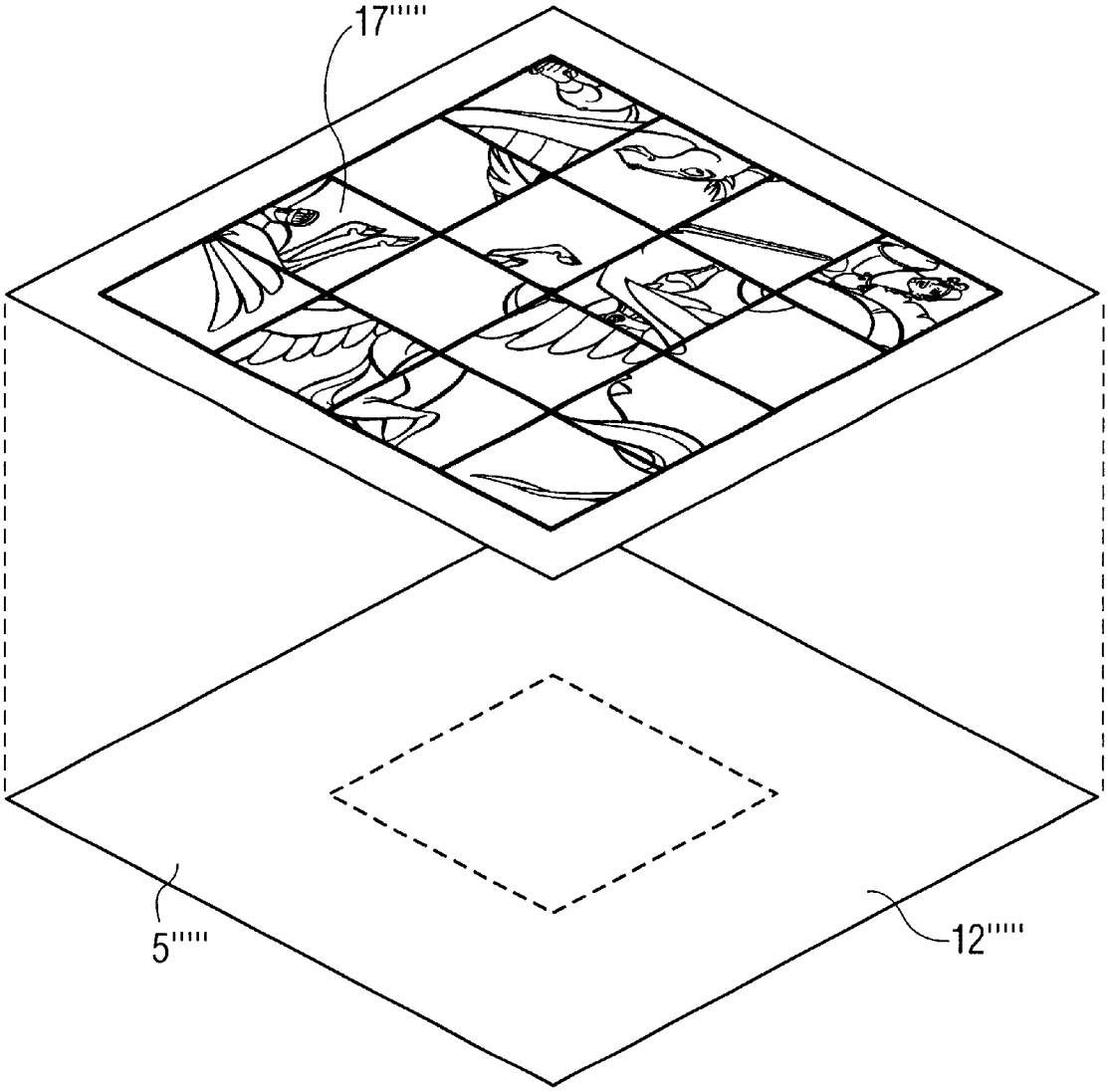
FIG. 11 is an exploded perspective view of a puzzle in accordance with a fifth variant of the preferred embodiment of the invention.

In still a further embodiment of invention, shown in FIG. 10, the top surface 12'''' of the bottom layer 5'''' is coated with a repositionable adhesive 35'''' and is otherwise identical to the bottom layer 5'''' described with respect to FIGS. 1–6. The top layer 3'''' is also identical to the construction of the top layer 3'''' described with respect to FIGS. 1–6.

A transparent intermediate layer 4'''' has a top surface 37'''' and a bottom surface 39'''' each covered with a silicone coating. On the bottom surface 39'''' of the intermediate layer 4'''' here are printed text and/or graphics in mirror image so that they can be viewed through the top surface 37'''' of the intermediate layer 4''''.

The silicone coating on the bottom surface 39'''' of the intermediate layer 4'''' permits the intermediate layer 4'''' to be peeled away from the bottom layer 5'''', leaving no sticky surface on the intermediate layer 4'''' which can then be used as a coupon, ticket, decorative picture or for many other purposes as disclosed above.

Because the repositionable adhesive 35'''' has a greater affinity for the top surface 12'''' of the bottom layer 5'''' then for the silicone-coated bottom surface 39'''' of the intermediate layer 4'''', the repositionable adhesive 35'''' remains on the top surface 12'''' of the bottom layer 5'''' after the intermediate layer 4'''' is peeled away. The top surface 12'''' of the bottom layer 5'''', which has puzzle pieces forming an unscrambled image on its bottom surface 19'''', can then be pressed onto a support surface, e.g., on wall, a canvas, a page of a book, or virtually any other surface. The repositionable adhesive 35'''' enables the bottom layer to be moved after it is pressed onto the supporting surface until the exact desired position is obtained. With passage of time, the repositionable adhesive 35'''' will set, fixing the bottom layer 5'''', with puzzle pieces attached, in place. The intermediate layer 4'''' can be used separately as previously described.

In FIGS. 11–14 there is illustrated still another variant of the invention, this one being identical to the one of FIGS. 1–4 except as follows.

Correspondence between the puzzle pieces 17''''' peeled away from the silicone-coated top surface 12'''' of the bottom layer 5'''' and the grid squares on the on the bottom surface of the bottom layer 5'''' is not provided by numbers on the faces of the puzzle pieces 17''''' (see FIG. 11) and grid squares as shown in FIGS. 1–4. Instead, each grid square has a graphical representation of a person, place or thing and the underside of each puzzle piece 17''''' has a textual clue which corresponds to one of the graphical representations.

Figure 12:
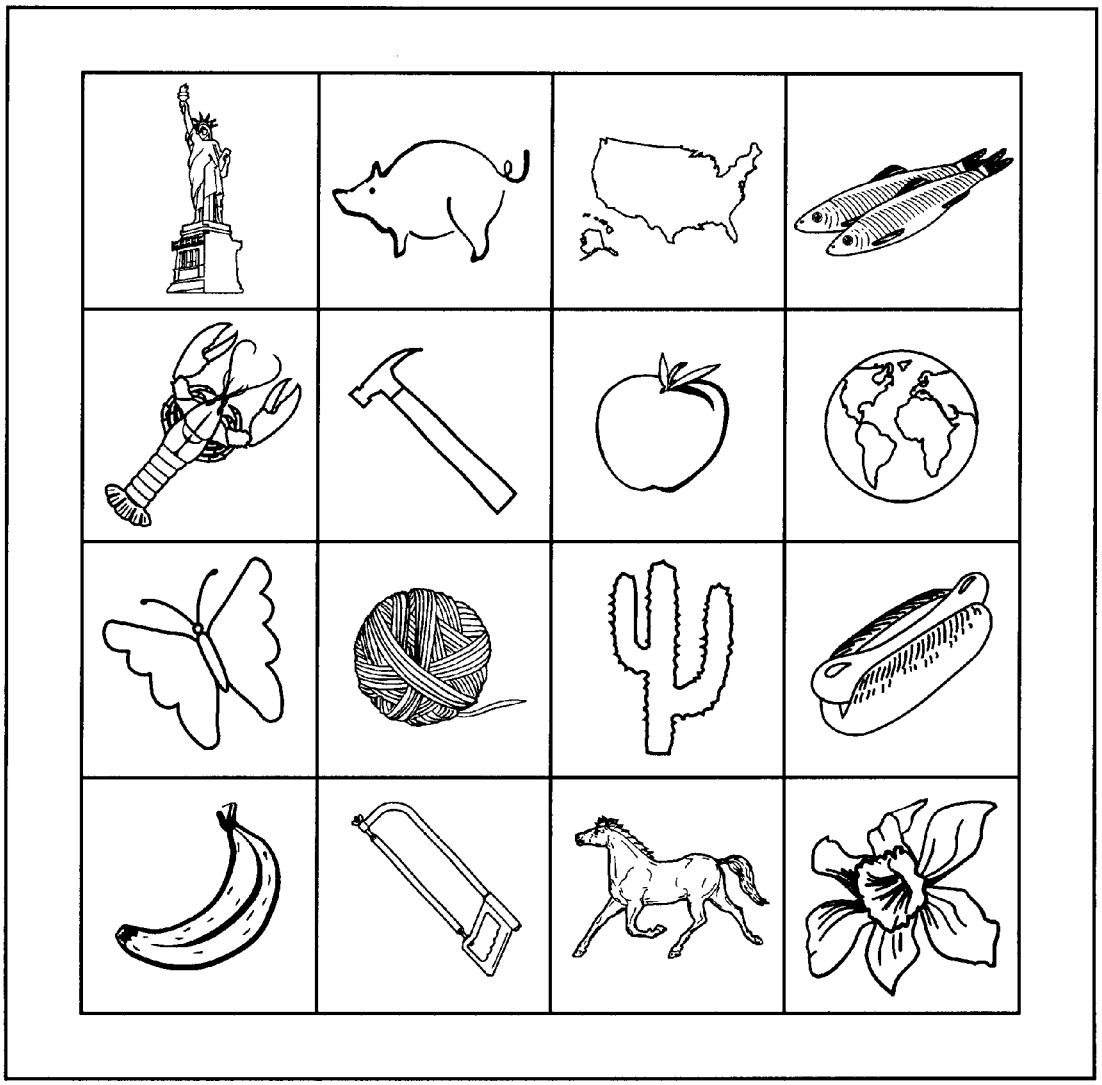
FIG. 12 is a side elevation view of the puzzle of FIG. 11.
Figure 13:
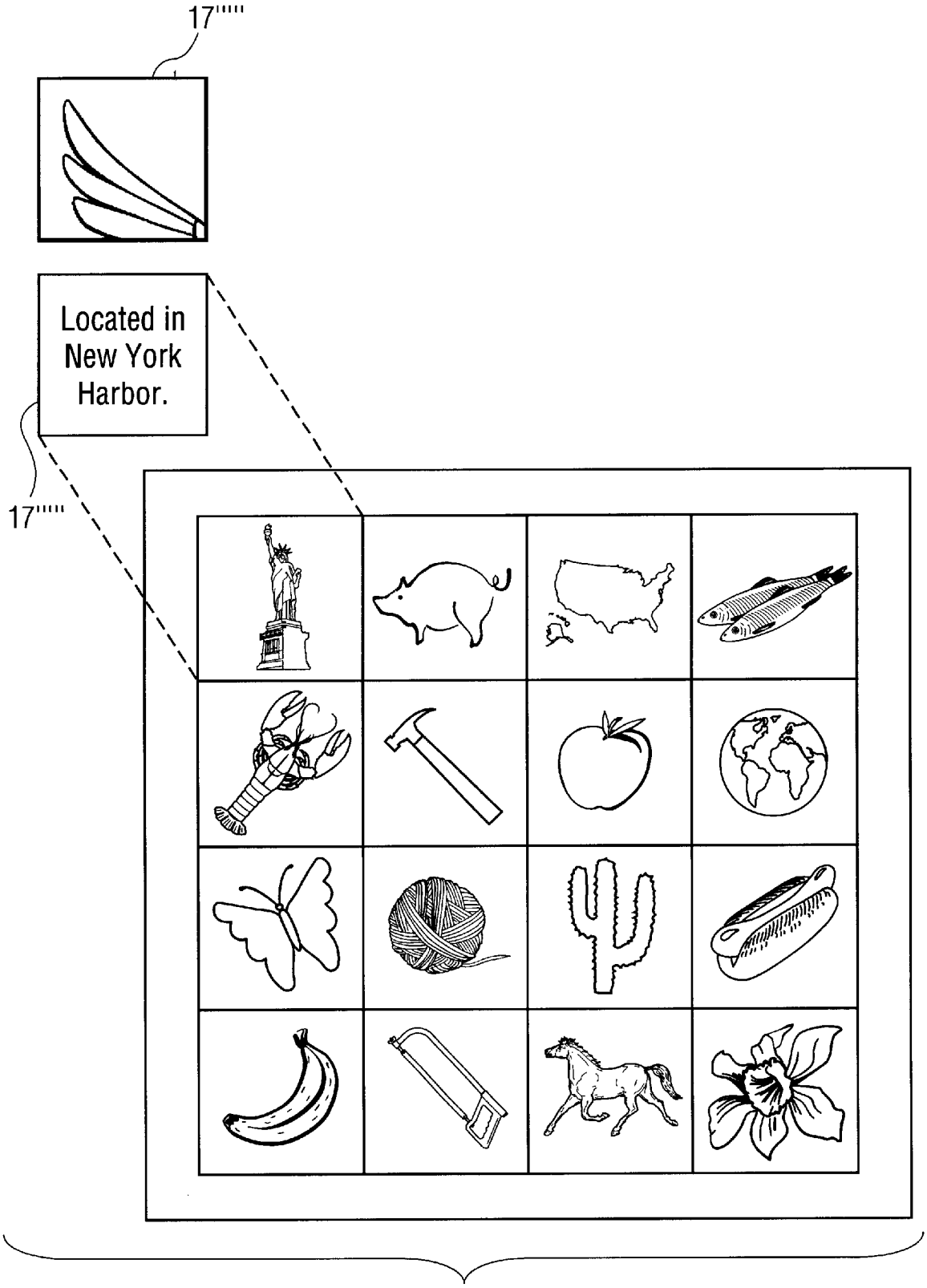
FIG. 13 is a bottom plan view of the puzzle of FIG. 11.
Figure 14:
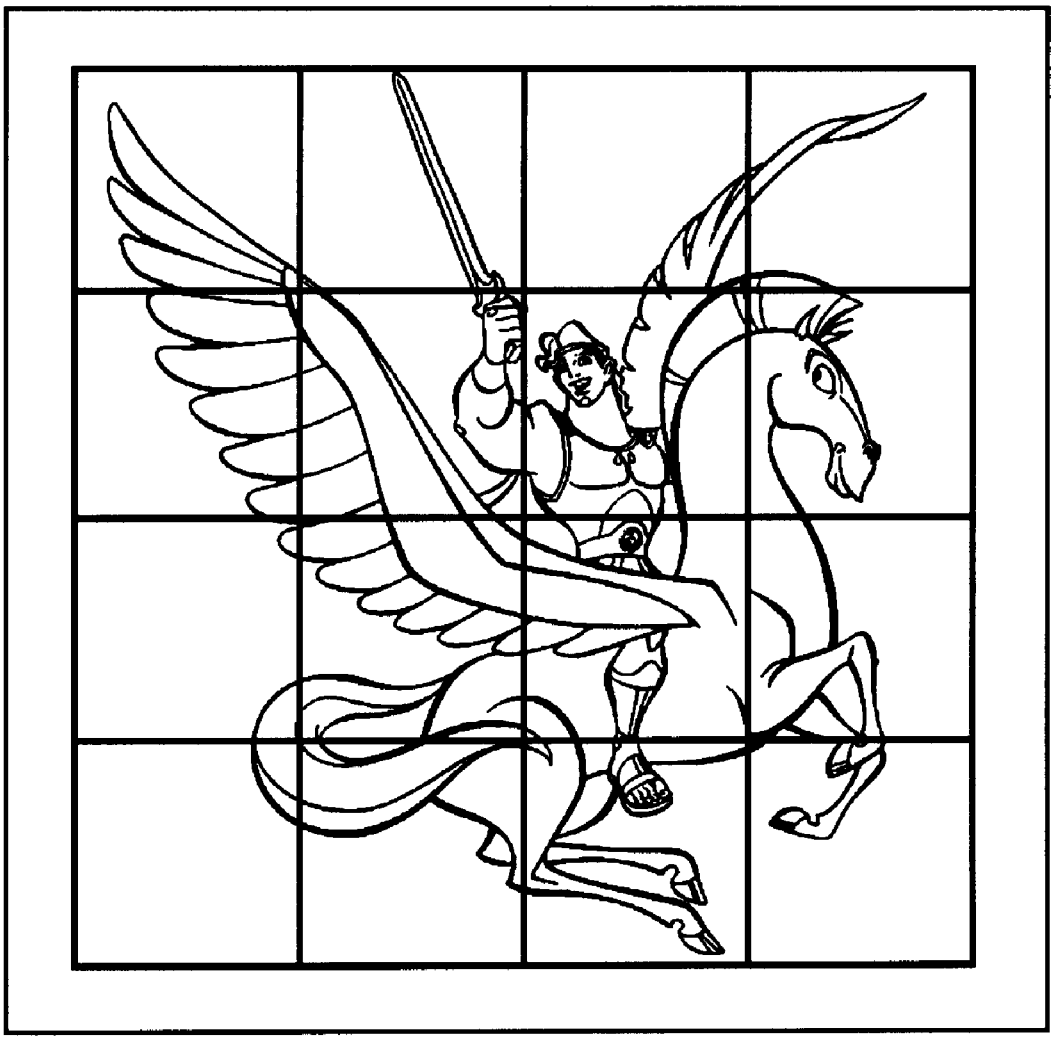
FIG. 14 is a bottom plan view of the puzzle of FIG. 11 in a completed state.

For example as seen in FIG. 12, the uppermost, leftmost grid square as a graphical representation of the Statue of Liberty. One of the puzzle pieces 17''''' shown in FIG. 13, has printed on its underside, the clue "Located in New York Harbor." The adhesive on the underside of the puzzle pieces 17''''' is transparent so that the text of each clue can be viewed through the adhesive. After each of the puzzle pieces 17''''' is applied with its clue-bearing side face down on the grid box with the graphical representation corresponding to its clue, the image shown in FIG. 14 is fully assembled on the bottom surface of the bottom layer 5''''.

It is to be appreciated that the foregoing is a description of several variants of a preferred embodiment of the invention to which modifications may be made without departing from the spirit and scope of the invention.

What is claimed is:

1. A puzzle game comprising a top layer having a plurality of disorderly arranged sections each of which has a top surface that bears a portion of a first image, said first image being scrambled, and a bottom surface with a pressure-sensitive adhesive, an intermediate layer, and a bottom layer, having a top surface with an affinity for pressure-sensitive adhesive less than that of the bottom surface of the top layer sections, and a bottom surface on which there is imprinted information for orderly arranging said top layer sections thereon in a configuration in which the first image is unscrambled, the pressure-sensitive adhesive on the bottom surfaces of the top layer sections, when subjected to pressure, affixing the bottom surfaces of the top layer sections to the bottom surface of the bottom layer thereby producing an assemblage bearing said unscrambled first image, said intermediate layer being disposed between said top layer and said bottom layer and having a top surface and a bottom surface, said intermediate layer top surface having an affinity for pressure-sensitive adhesive less than that of the bottom surfaces of the top layer sections, and bearing another image, whereby said another image can be seen, and said intermediate layer separated from said bottom layer, only after said top layer sections are separated for attachment to said bottom layer bottom surface.

2. A puzzle game according to claim 1 wherein said intermediate layer is transparent.

3. A puzzle game according to claim 2 wherein said another image is imprinted in reverse on the bottom surface of said intermediate layer whereby said another image may be viewed through the top surface of said intermediate layer.

4. A puzzle game according to claim 1 wherein the top surface of said intermediate layer is imprinted with said another image.

5. A puzzle game according to claim 1 wherein said intermediate layer bottom surface has a pressure-sensitive adhesive with a greater affinity for the top surface of said bottom layer than for the bottom surface of said intermediate layer.

6. A puzzle game according to claim 1 wherein said top layer and said bottom layer are congruent.

7. A puzzle game according to claim 1 wherein said intermediate layer is congruent with said top layer and said bottom layer.

8. A puzzle game comprising a top layer having a plurality of disorderly arranged sections each of which has a top surface that bears a portion of a first image, said first image being scrambled, and a bottom surface with a pressure-sensitive adhesive, an intermediate layer, and a bottom layer, having a top surface coated with an adhesive, and a bottom surface on which there is imprinted information for orderly arranging said top layer sections thereon in a configuration in which the first image is unscrambled, the pressure-sensitive adhesive on the bottom surfaces of the top layer sections, when subjected to pressure, affixing the bottoms surfaces of the top layer sections to the bottom surface of the bottom layer thereby producing an assemblage bearing said unscrambled first image, said intermediate layer being disposed between said top layer and said bottom layer and having a top surface with an affinity for the adhesive on the bottom surface of the top layer which is less than the affinity of the bottom surface of the top layer for the adhesive on the bottom surface of the top layer, and a bottom surface with an affinity for the adhesive on the top surface of the bottom layer which is less than the affinity of the top surface of the bottom layer for the adhesive on the top surface of the bottom layer, whereby said top surface of said intermediate layer is exposed when said puzzle pieces are affixed to said bottom layer, and said intermediate layer can then be peeled away from said bottom layer free of adhesive.

9. A puzzle game according to claim 8 wherein the top surface of said bottom layer is coated with a fugitive adhesive.

10. A puzzle game according to claim 8 wherein the top surface of said bottom layer is coated with a repositionable adhesive.

* * * * *